United States Patent [19]

Evertz et al.

[11] Patent Number: 4,679,355

[45] Date of Patent: Jul. 14, 1987

[54] APPARATUS FOR GRINDING A SEMIFINISHED STEEL PRODUCT

[75] Inventors: Egon Evertz, Vorlander Strasse 23, D-5650 Solingen; Rolf Seybold, Solingen, both of Fed. Rep. of Germany

[73] Assignee: Egon Evertz, Solingen, Fed. Rep. of Germany

[21] Appl. No.: 862,653

[22] Filed: May 13, 1986

[30] Foreign Application Priority Data

May 14, 1985 [DE] Fed. Rep. of Germany ..... 3517302

[51] Int. Cl.[4] ..... B24B 19/00

[52] U.S. Cl. ..... 51/99; 51/101 R; 51/102; 51/105 R; 51/165.71; 74/393; 74/437; 409/139

[58] Field of Search ..... 51/99, 100 R, 101 R, 51/105 R, 165 R, 165.71, 165.75, 165.9, 165.91, 165.78, 165.79, 166 MH, 102, 262 R, 79; 74/393, 437; 409/139

[56] References Cited

U.S. PATENT DOCUMENTS

| | | | |
|---|---|---|---|
| 2,347,639 | 4/1944 | Platt | 51/79 |
| 2,558,943 | 7/1951 | Ellison | 51/79 |
| 3,040,481 | 6/1962 | De Vlieg | 51/100 R |
| 3,823,617 | 7/1974 | Infanger et al. | 74/437 X |
| 3,918,209 | 11/1975 | Crawley et al. | 51/99 X |
| 4,343,114 | 8/1982 | Tourasse et al. | 51/165.71 |

FOREIGN PATENT DOCUMENTS

| | | | |
|---|---|---|---|
| 138618 | 11/1900 | Fed. Rep. of Germany . | |
| 966400 | 10/1950 | France | 8/2 |

*Primary Examiner*—Robert P. Olszewski

*Attorney, Agent, or Firm*—Holman & Stern

[57] ABSTRACT

An apparatus grinding a steel billet to remove surface cracks. The billet is advanced in the direction of it longitudinal axis while being rotated. The apparatus includes a grinding wheel mounted in a bearing in a movably mounted support member. In order to accurately and simply control the penetration depth of the grinding wheel, a stop member is mounted on the support member. In one embodiment, the stop member is a segment of a circle mounted eccentrically relative to the grinding wheel. In another embodiment, the stop member is a segment of a spiral mounted coaxially with the grinding wheel. The stop member engages the surface of the billet. Two arrangements are described for rotating the billet at an increased speed while grinding the edge regions.

13 Claims, 6 Drawing Figures

3
22
23
33
35
26
16
24
36
37
38
P
N
39
25

APPARATUS FOR GRINDING A SEMIFINISHED STEEL PRODUCT

BACKGROUND OF INVENTION

The invention relates to an apparatus for grinding semifinished steel products, particularly but not exclusively in the form of billets, requiring material removal up to the depth of penetration of cracks near the surfaces. The apparatus includes a grinding wheel which is movable in respect of its height position relative to the semifinished product and has its axis arranged substantially parallel with the longitudinal axis of the product whilst the semifinished product is simultanenously advanced in the direction of its longitudinal axis and rotated about the latter. A stop member in the shape of a segment having approximately the same curvature as the grinding wheel relative to the grinding wheel axis controls the position of the grinding wheel relative to the surface of the semifinished product so that material is removed uniformity around the entire periphery of the semifinished product. The stop member is vertically adjustable and rests on the unabraded surface of the semifinished product at a position which is spaced beneath the point of engagement of the grinding wheel by a distance which corresponds to the penetration depth of the grinding wheel.

Such an apparatus is known from U.S. Pat. No. 2,347,639. In that case an arcuate stop member in the form of a slipper is vertically adjustable by means of a screwspindle on an arm which is secured to a support. The support engages operatively with a lever which carries the bearing of the grinding wheel. In practice a multi-link mounting assembly of this type not only leads to a very expensive construction but also to substantial transmission faults due to dimensional deviations of the individual links from their respective designed measurements and their progressive wear which is very considerable under the rough operative conditions involved in the grinding of semifinished steel products.

A similar device for grinding semifinished steel products is also known from U.S. Pat. No. 2,558,943. Here switch levers are provided on both sides of continuously advancing steel billets to be ground. These levers are encountered by the billet edges on turning and trigger the switches of switching circuits which by means of further switches for which a cam controlled by sensor fingers resting on the faces of the billets and associated with an actuating device is provided which controls the supply of compressed air to pneumatic cylinders. The latter have one part thereof mounted on the machine frame whilst their respective other parts are applied to a bearing arm of the grinding wheel and thus allows grinding pressure to be modified in relation with the given rotational position of the billet. This grinding pressure control is so arranged that in the vicinity of the edges the application pressure is reduced so that corresponding to the longer dwelling time in this region some equalisation is obtained. However, in so far as the preselected relation of grinding pressure to angular position does not correspond to the actual functional conditions, the intended equalisation is only partly achieved. In particular, the specific grinding pressure depends very largely on the material composition. Added to this it must be remembered that even if all the other material influences are known, local strength variations in the semifinished products cannot be detected and that these may well be the cause for inadequate equalisation of material abrasion.

It is further known, according to French Pat. No. 66 400, in the grinding of billets to reduce the edge pressure of the grinding wheel by means of an hydraulic control system which in turn is subject to the influence of an hydraulic adjusting member which is charged by a roller sitting on a template which revolves with the billet. The actual billet measurements however are not detected in this case. Moreover, the grinding-pressure control is subject to the above described influential factors.

BRIEF SUMMARY OF THE INVENTION

It is an object of this invention to provide a semifinished steel product which has a reliable and simple construction and which has fewer transmission faults than the prior art arrangements.

According to one aspect of this invention there is provided an apparatus for grinding a semifinished steel product which requires removal of material up to the penetration depth of cracks near the surface thereof and which is advanced in the direction of the longitudinal axis thereof whilst being rotated about said longitudinal axis, said apparatus comprising a support member movably mounted on the apparatus, a bearing provided in said support member, a grinding wheel mounted in said bearing with its axis parallel to the longitudinal axis of the semifinished product and arranged so that its axis is movable relative to the semifinished product, a stop member in the form of a segment of a circle pivotally mounted on the support member so that the segment is eccentric relative to the axis of the grinding wheel, and means for pivotally adjusting and locking the stop member in position, said stop member resting on the unabraded surface of the semifinished product at a position which is spaced from the point of engagment of the grinding by a distance which corresponds to the penetration depth of the grinding wheel and said stop member controlling the position of the grinding wheel relative to the surface of the semifinished product so that material is removed uniformly around the entire periphery of the semifinished product.

According to another aspect of this invention there is provided an apparatus for grinding a semifinished steel product which requires removal of material up to the penetration depth of cracks near the surface thereof and which is advanced in the direction of the longitudinal axis thereof whilst being rotated about said longitudinal axis, said apparatus comprising a support member movably mounted on the apparatus, a bearing providing in said support member, a grinding wheel mounted in said bearing with its axis parallel to the longitudinal axis of the semifinished product and arranged so that its axis is movable relative to the semifinished product, a stop member in the form of a segment of a spiral pivotally mounted on the support member coaxially with the axis of the grinding wheel, and means for pivotally adjusting and locking the stop member in position, said stop member resting on the unabraded surface of the semifinished product at a position which is spaced from the point of engagement of the grinding wheel by a distance which corresponds to the penetration depth of the grinding wheel and said stop member controlling the position of the grinding wheel relative to the surface of the semifinished product so that material is removed uniformly around the entire periphery of the semifinished product.

One basic feature of the invention resides in that the stop member is adjusted not by means of a vertical longitudinal sliding displacement thereof, but by virtue of pivotal movement. The pivotal bearing of the stop member is mounted on the support member in the immediate vicinity of the grinding wheel axis or even coaxial therewith. The position of the segment which forms the stop member is in such a construction transmitted directly, or with minimum play, to the bearing of the grinding wheel so that the grinding wheel wall with high precision execute that degree of material removal which has been predetermined by the setting of the segment. The correct penetration depth is also achieved by varying the material strength or its hardness values by making variations in its composition or heat treatment. For grinding steel billets the segment can be so closely set that the point of contact of the grinding wheel is spaced from the point of contact of the stop member by approximately 1 mm.

The longitudinal feed movement of the semifinished product on the one hand, and its rotation about the longitudinal axis on the other, result in a slightly spiral grinding trace in which the grinding pass widths overlap. The pitch of this spiral trace, whilst not being very strongly marked, is sufficient to be obliquely directed relative to the cutting line in the case of a right angle cut as is very frequently required for semifinished products. For this reason it is not possible for any damage such as grinding cracks or the like to issue from the grinding traces in respect of sections cut off the semifinished product vertically relative to its longitudinal axis.

The execution of the stop member in the form of a segment of a circle is technologically particularly easy. On the other hand, a stop member in the form of a spiral segment has the advantage of being capable of coping also with larger variations in height position.

Wear on the segment itself can be reduced by providing the end stop with a roller follower which rests in contact on top of the product.

The adjusting and locking means may be realized in various ways. In particular, it is of advantage if the adjusting and locking means is amenable to automation such that the stop member can be adjusted for a given degree of grinding abrasion for each meter length of billet.

In the simplest form, the adjusting and locking means comprises a holder having an internal screw thread mounted on said support member and a screw threaded spindle threadly mounted in said holder and engaging said stop member. The spindle may be adjusted, when required, in a desired manner.

Alternatively, the adjusting and locking means may comprise a piston-cylinder unit, one part of said unit being mounted on the support member and the other part operatively engaging the stop member.

Normally, the grinding wheel has a cylindrical work face. Since abrasion must be effected in a plane, it necessary that the longitudinal axis of the semifinished product and the grinding wheel axis are parallel to each other. However, under unfavorable conditions, that is to say if the support member which carries the grinding wheel bearing is sufficiently firmly mounted, the points of support of the grinding wheel and the points of support of the stop member may cause a slight amount of angular inclination of the grinding wheel axis.

This problem may be avoided by providing a second stop member mounted on the support member adjacent the side of the grinding wheel which faces the abraded surface of the semifinished product, said second stop member resting on the abraded surface of the semifinished product at a distance from the axis of the grinding wheel which is the same as the distance between the point of engagement of the grinding wheel and the axis of the grinding wheel.

The apparatus may also include means for detecting the rotational positions of the semifinished product. Such means may be functionally influenced directly by the configuration of the stop member. For example, the rotational position detecting means may comprise a position indicator mounted on the support member and an adjustable contactor coacting with the position indicator. Desirably, the position indicator reaches the contactor when the height position of the segment has been lifted by more than two percent from its lowest position. A lift of more than two percent corresponds to a billet rotating through approximately 20° with the grinding wheel engaging the billet between its corners. The position indicator will fall again to the level of the contactor after the billet has rotated through about 70° and the grinding wheel has passed over a corner of the billet.

Alternatively, the rotational position detecting means may comprise a cruciform shaped switch operating member which rotates together with the semifinished product, and a switch operated by said switching member, said operating member closing said switch each time the semifinished product has rotated through 90° and maintaining the switch in a closed state for rotation through an angle less than 90°.

Preferably where the product has an approximately square cross-section, said apparatus includes means for rotating the semifinished product, said rotating means being responsive to the rotational position detecting means, and, during each rotation of 90°, said rotating means rotates the product approximately three times as fast during rotation through each angle of approximately 35° with the grinding wheel adjacent to a corner of the product than during rotation through an angle of approximately 20° with the grinding wheel between the corners of the product.

Alternatively, the apparatus may include means for varying the speed of rotation of the semifinished product, said means comprising a drive motor, a transmission gear member rigidly mounted on the semifinished product, and an elliptical gear transmission train having an input gear member driven by the motor and an output gear member driving said transmission gear member, the circumference of the transmission gear member being four times greater than that of the output gear member, whereby the product is driven faster when the grinding wheel engages portions adjacent to its corners than when the grinding wheel engages portions between its corners.

Where the product has a substantially square cross-section, the position of the stop member may be adjusted in accordance with the rotation of the product subject to the condition that the grinding wheel is lifted in the region of the corners of the product.

DETAILED DESCRIPTION

Figure 3:
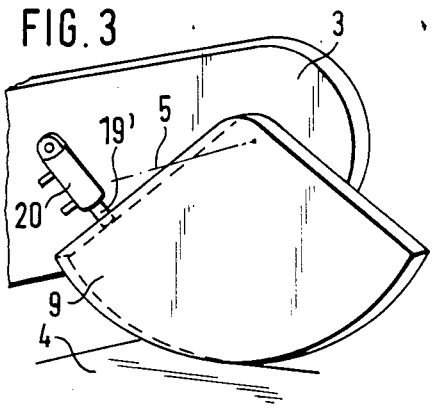
FIG. 3 shows a modification to the adjustment device for a stop member forming part of the apparatus of FIG. 1.

Referring now to the drawings, there is shown an apparatus which includes a grinding wheel 2. The axis 1 of the grinding wheel 2 is mounted in a bearing 10 provided in an elongated support member 3 which consists of two mutually parallel arms. In addition to this, driving means for the grinding wheel are provided. This means comprises a belt pulley, not shown, over which passes a drive transmitting belt which transmits drive from a motor mounted at the other end of the support member 3.

The grinding wheel 2 rotates about an axis 5 which extends parallel with the longitudinal axis 16 of a billet 14 which is to be machined. The billet 14 is advanced in the feed direction as well as being rotated during this movement about its longitudinal axis 16 in the direction of arrow 17. As a result of these provisions the grinding wheel 2 is abrasively applied to the surface 4 of the billet 14 with a sufficient depth of penetration 6 into the billet surface 4 to remove cracks which originate from the surface 4.

A stop member which comprises a segment of a spiral is mounted on the grinding wheel bearing 10 on the side of the as yet unabraded billet surface 4 and therefore pivotally coaxially with the grinding wheel axis 5. In order to achieve adjustment and locking, the segment 9 is engaged by a screw threaded spindle 18 which cooperates with a holder 12 mounted on the support member 3. By rotation of the spindle 12, the segment 9 can be variably adjusted and locked in position in such a way as to ensure that the predetermined height difference of the contact point 7 of the segment 9 relative to the contact point of grinding wheel 2 is maintained.

For improved stabilisation of the grinding wheel axis 5, as mentioned earlier on, a further stop member 19 is arranged on the opposite side to stop member 9 with its point of contact 13 with the already abraded billet surface 11 at the same level as the grinding wheel 2. This provides on both sides of the grinding wheel bearing 10 an identically high support for the two-armed support member 3 by means of stop members 9 and 19 relative to the billet surfaces 4 and 11 respectively.

Figure 2:
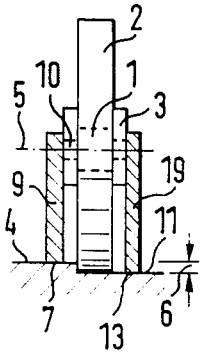
FIG. 2 is a schematic front view of a grinding wheel forming part of the apparatus of FIG. 1.

The stop member 19 shown in FIG. 2 also affords continued support for grindng wheel 2 in one end position of the billet 14 when the feed of the billet 14 is almost fully advanced and the stop member 9 no longer engages the billet 14.

Furthermore, the height adjusting mechanism for the stop member 9 can be controlled advantageously in such a way that in relation with the rotation angle of the billet there will be produced a variation in spacing in consequence of which the grinding wheel 2 will be lifted in the corner regions of the billet.

According to FIG. 3, the adjustment of the segment 9 is obtained with the aid of a piston-cylinder unit having a piston rod 19' and a cylinder 20. The position rod 19' engages operatively with the segment 9 whilst the cylinder 20 is hinged to the support member 3 which carries the grinding wheel bearing 10. The cylinder 20 is connected to an hydraulic unit.

Figure 4:
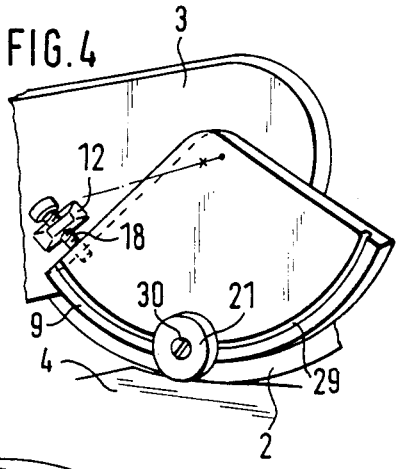
FIG. 4 shows a modification to the stop member.

In the embodiment according to FIG. 4, the segment 9 is equipped with a roller follower 21. In this case, the circular edge of the segment 9 has a somewhat smaller radius. The segment has, as indicated in the drawing, an undercut groove track 29 in which is guided a threaded nut, not discernible in the drawing, so that a bearing bolt 30 on which the roller 21 is mounted, can be screwed down and made fast. The roller 21 will in each case be fixed in a position suitable for a limited range of height adjustment for segment 9.

Figure 1:
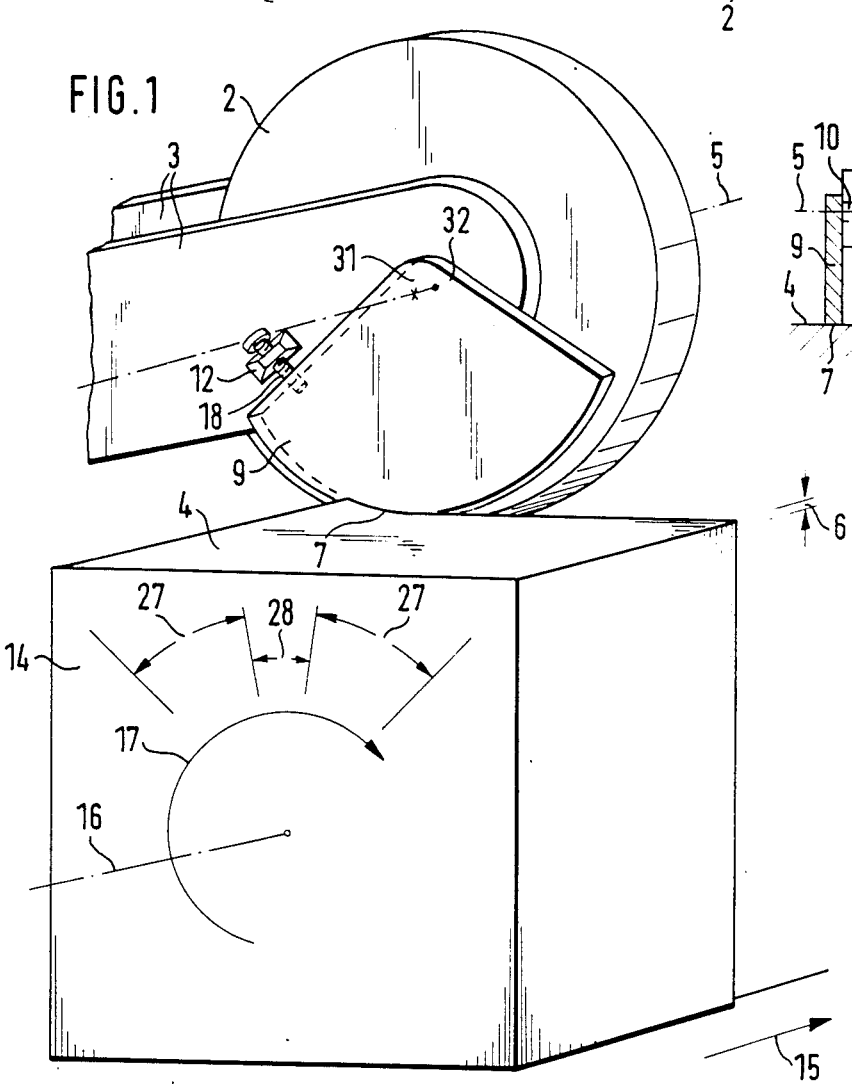
FIG. 1 is an isometric view of an apparatus embodying this invention.
Figure 5:
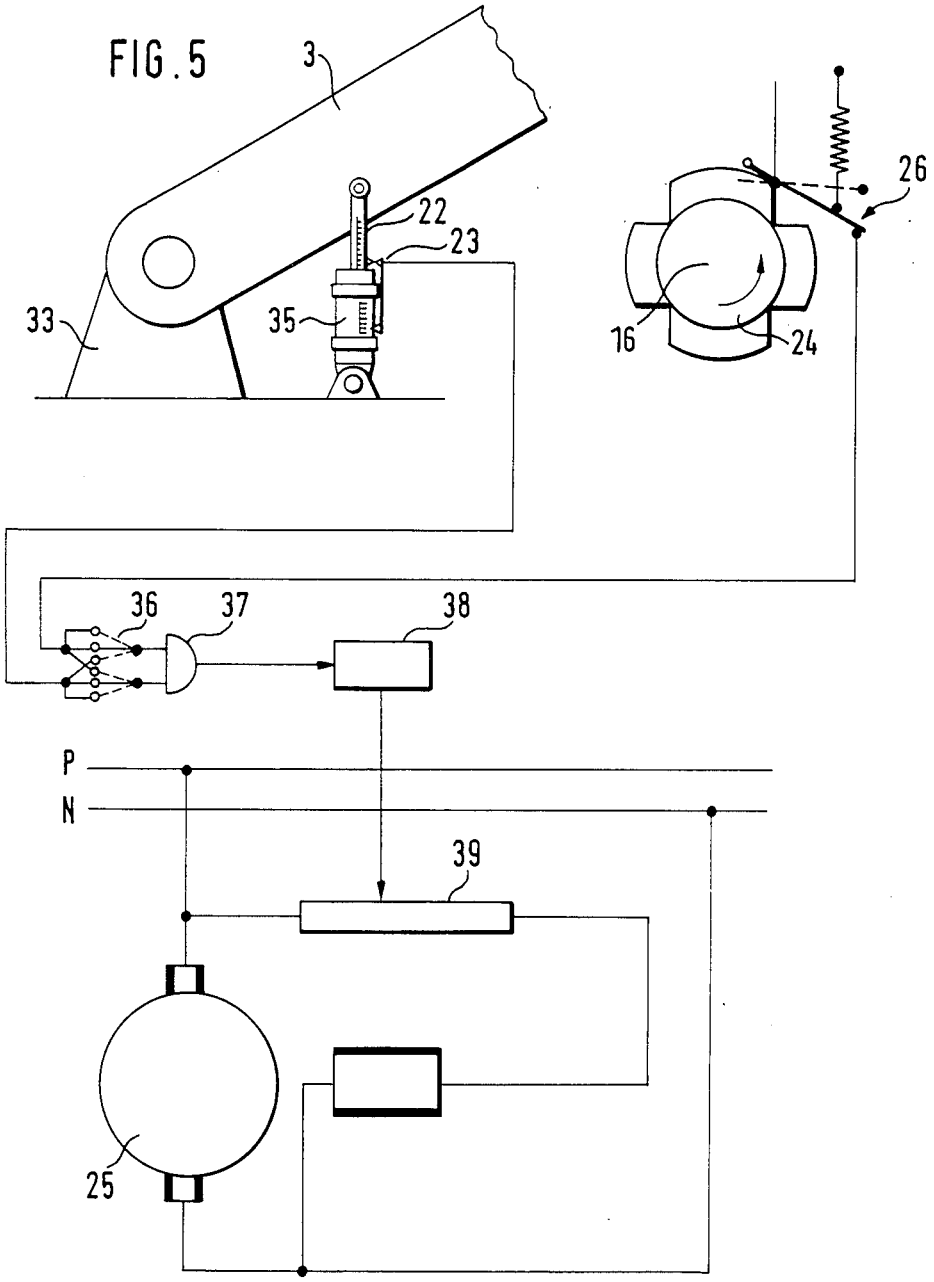
FIG. 5 is a block diagram of an arrangement for varying the rotational speed of the semifinished product in accordance with its rotational positions.

As hereinbefore proposed, the segment 9 may be a segment of a circle or a segment of a spiral. In the case of a circle segment, the centre point 31 of the circle, as shown in FIG. 1, is slightly spaced away from the pivot bearing 32 of the segment 9. The bearing 32 passes through the grinding wheel axis 5 so that there is an eccentricity relative to the pivot of grinding wheel 2 which passes through the axis 5. However, the pivot bearing 32 may also be considered as the centre point of a spiral of which segment 9 represents one segmental portion. In that case, there is no need for eccentricity between the spiral centre and the grinding wheel axis 5. The circumferential path of the segment is largely identical in both cases and for this reason no drawing of the modification is provided.

The support member 3 which carries the bearing of the grinding wheel 2 is mounted for pivotal movement in a stationary bearing block 33 so that the central longitudinal line may assume various inclinations.

An indicator 22 which is provided with a scale is slidably mounted in a guide 35 and hinged to the support member 3 which carries the grinding wheel bearing. The guide 35 is non-displaceably hinged. The guide 35 is provided with a scale for the adjustment of a contact 23 which is adapted to be set to cooperate with an opposing contact mounted on the indicator 22. In practice, the highest and lowest positions in the course of revolution of a billet can be more easily read on the indicator 22 so that, starting from the lowest position, the contact 23 can be set to a specified height position. As mentioned, it is advisable to set the contact 22 to a height position which is 2% above the lowest position. From contact 23, a current signal lead directly to a selection switch 36 for an AND gate 37. Also applied to this contact switch 36 is a current signal from a switch 26. This switch 26 is subject to operation by a cruciform switching member 24 which revolves with the billet 14 and displaces a switching lever into its contact making position during this revolution in the manner already described. Preferably, the arrangement will be made such that a different switching state prevails during rotation through a central angular range 28° of 20° than in the two adjoining ranges 27 on either side each comprising 35° and extending to a corner of the billet 14. For a clearer understanding, these two anglular ranges 27, 28 are shown in FIG. 1.

The AND gate 37 allows selectively the contact 23 or the switch 26, or both these elements, to be processed as input signals by corresponding adjustment of the selection switch 36. An amplifier 38 processes the received signal in such a manner that, in accordance with the output of the amplifier 38, a field regulator 39 of a direct-current shunt-wound motor 25 can be set to two different values so that the rotational speed of the driving motor 25 is three times as fast during rotation through angular range 27 than it is during rotation through angular range 28.

Figure 6:
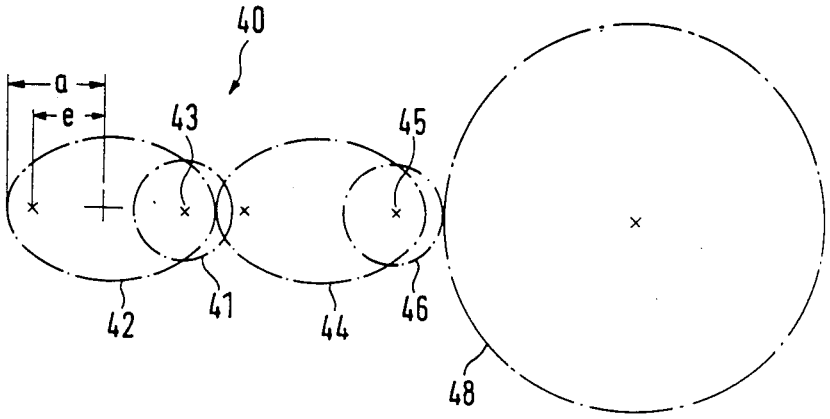
FIG. 6 shows an alternative arrangement for varying the rotational speed of the product.

An alternative arrangement for driving the semifinished product at a non-uniform speed is shown in FIG. 6. According to this arrangement there is provided an elliptical gear train 40 which is drivingly connected via gear wheel 41 to a driving motor revolving at constant speed. Jointly with gear wheel 41 an elliptical gear 42 rotates about one focus 43 thereof. Gear 42 is in mesh with an elliptical gear 44 which has the same size and revolves about its focus 45. There is also a rigid connection between gear 44 and an output gear 46. Gear 46 drives a gear or pinion 48 whose circumference is four times greater than that of gear 46. Consequently, in the course of one revolution of gear 48 there will be periodically four occasions of increased speed. The gear 48 is rotationally rigidly connected to the semifinished product or billet 14 in such a manner that an increased speed will be obtained in the angular range 27 adjacent the corners of the billet 14 relative to the angular range 28 between the corners of the billet 14. These angular ranges are shown in FIG. 1.

The extent of non-uniformity may be selected by a choice of the eccentricity e and the major axis a of the two congruent elliptical gears so that in this manner a suitably higher speed can be applied in the corner regions than in the central region of the semifinished product.

We claim:

1. An apparatus for grinding a semifinished steel product which requires removal of material up to the penetration depth of cracks near the surface thereof and which is advanced in the direction of the longitudinal axis thereof whilst being rotated about said longitudinal axis, said apparatus comprising a support member movably mounted on the apparatus, a bearing provided in said support member, a grinding wheel mounted in said bearing with its axis parallel to the longitudinal axis of the semifinished product and arranged so that its axis is movable relative to the semifinished product, a stop member in the form of a segment of a circle pivotally mounted on the support member with its pivotal axis coaxial with the axis of the grinding wheel but spaced from the center of the circle so that the circle is eccentric relative to the axis of the grinding wheel, and means for pivotally adjusting and locking the stop member in position, said stop member resting on the unabraded surface of the semifinished product at a position which is spaced from the point of engagement of the griding where by a distance which corresponds to the penetration depth of the grinding wheel and said stop member controlling the position of the grinding wheel relative to the surface of the semifinished product so that material is removed uniformly around the entire periphery of the semifinished product.

2. An apparatus for grinding a semifinished steel product which requires removal of material up to the penetration depth of cracks near the surface thereof and which is advanced in the direction of the longitudinal axis thereof whilst being rotated about said longitudinal axis, said apparatus comprising a support member movably mounted on the apparatus, a bearing providing in said support member, a grinding wheel mounted in said bearing with its axis parallel to the longitudinal axis of the semifinished product and arranged so that its axis is movable relative to the semifinished product, a stop member in the form of a segment of a spiral pivotally mounted on the support member coaxially with the axis of the grinding wheel, and means for pivotally adjusting and locking the stop member in position, said stop member resting on the unabraded surface of the semifinished product at a position which is spaced from the point of engagement of the grinding wheel by a distance which corresponds to the penetration depth of the grinding wheel and said stop member controlling the position of the grinding wheel relative to the surface of the semifinished product so that material is removed uniformly around the entire periphery of the semifinished product.

3. An apparatus as claimed in claim 1 or claim 2 in which the stop member is provided with a roller follower.

4. An apparatus as claimed in claim 1 or claim 2 in which the adjusting and locking means comprises a holder having an internal screw thread mounted on said support member and a threaded spindle threadedly mounted in said holder and engaging said stop member.

5. An apparatus as claimed in claim 1 or claim 2 in which the adjusting and locking means comprises a piston-cylinder unit, one part of said unit being mounted on the support member and the other part operatively engaging the stop member.

6. An apparatus as claimed in claim 1 or claim 2 comprising a second stop member mounted on the support member adjacent the side of the grinding wheel which faces the abraded surface of the semifinished product, said second stop member resting on the surface abraded surface of the semifinished product at a distance from the axis of the grinding wheel which is the same as the distance between the point of engagement of the grinding wheel and the axis of the grinding wheel.

7. An apparatus as claimed in claim 1 including means for detecting the rotational position of the semifinished product.

8. An apparatus as claimed in claim 7 in which the rotational position detecting means comprises a position indicator mounted on the support member and an adjustable contactor coacting with the position indicator.

9. An apparatus as claimed in claim 8 in which the position indicator reaches the contactor when the height position of the segment has been lifted by more than two percent from its lowest position.

10. An apparatus as claimed in claim 7 in which the rotational position detecting means comprises a cruciform shaped switch operating member which rotates together with the semifinished product, and a switch operated by said switching member, said operating member closing said switch each time the semifinished product has rotated through 90° and maintaining the switch in a closed state for rotation through an angle less than 90°.

11. An apparatus as claimed in claim 7 further including means for rotating the semifinished product, said product having an approximately square cross-section, said rotating means being responsive to the rotational position detecting means and, during each rotation of 90° said rotating means rotating the product 5. times as fast during rotation through each angle of approximately 35° with the grinding wheel adjacent to a corner of the product than during rotation through an angle of approximately 20° with the grinding wheel between the corners of the product.

12. An apparatus as claimed in claim 1 or claim 2 in which the semifinished product has substantially square cross-section and in which the position of the stop member is adjusted in accordance with the rotation of the product subject to the condition that the grinding wheel is lifted in the region of the corners of the product.

13. An apparatus as claimed in claim 1 or claim 2 further including means for varying the speed of rotation of the semifinished product, said means comprising a drive motor, a transmission gear member rigidly mounted on the semifinished product, and an elliptical gear transmission train having an input gear member driven by the motor and an output gear member driving said transmission gear member, the circumference of the transmission gear member being four times greater than that of the output gear member, whereby the product is driven faster when the grinding wheel engages portions adjacent to its corners than when the grinding wheel engages portions between its corners.

* * * * *